United States Patent [19]

Daeuble

[11] 4,072,465

[45] Feb. 7, 1978

[54] DYEING POLYESTER FIBERS

[75] Inventor: Manfred Daeuble, Frankenthal, Germany

[73] Assignee: BASF Aktiengesellschaft, Ludwigshafen, Germany

[21] Appl. No.: 603,443

[22] Filed: Aug. 11, 1975

[30] Foreign Application Priority Data

Sept. 14, 1974 Germany ..... 2444102

[51] Int. Cl.[2] ..... D06P 5/04

[52] U.S. Cl. ..... 8/169; 8/172 R; 8/173

[58] Field of Search ..... 8/169, 172, 173

[56] References Cited

U.S. PATENT DOCUMENTS

| | | | |
|---|---|---|---|
| 2,863,714 | 12/1958 | Long et al. | 8/169 |
| 2,982,597 | 5/1961 | Salvin et al. | 8/169 |
| 3,233,961 | 2/1966 | Salvin et al. | 8/173 |
| 3,877,870 | 4/1975 | Dellian et al. | 8/173 |
| 3,932,121 | 1/1976 | Kawakami et al. | 8/169 |
| 3,989,456 | 11/1976 | Vescia et al. | 8/169 |

FOREIGN PATENT DOCUMENTS

| | | | |
|---|---|---|---|
| 635,408 | 11/1963 | Belgium | 8/173 |
| 609,947 | 10/1948 | United Kingdom. | |

*Primary Examiner*—William E. Schulz
*Attorney, Agent, or Firm*—Keil, Thompson & Shurtleff

[57] ABSTRACT

Polyester fibers are dyed with disperse dyes at temperatures above 100° C in an aqueous liquor containing, as leveling agents, emulsions of aliphatic esters, nitriles or ketones each containing from 7 to 16 carbon atoms, level shades being obtained.

10 Claims, No Drawings

DYEING POLYESTER FIBERS

This invention relates to a process for dyeing polyester fibers with disperse dyes at temperatures above 100° C in an aqueous liquor in the presence of a dyeing assistant.

It is known that ethoxylation products of organic compounds of various kinds such as fatty alcohols, alkyl phenols, fatty acids and also polypropylene glycol have a leveling action in processes for dyeing polyester fibers. This is described, for example, in German Published Application Nos. 1,184,730; 1,280,805 and 1,286,499. However, these products retard the dyes used to a very marked extent with the result that, for a given amount of dye, distinctly lighter shades are obtained than when dyeing is carried out without the addition of an assistant.

Furthermore, carriers of all kinds may be used for leveling out. However, they impair the lightfastness if not completely removed from the polyester fibers after dyeing. An overdose of such agents impairs the tensile strength of the fibers and results in paler shades.

In German Published Application No. 1,691,489, the use of a mixture of ethoxylation products, salts of alkylbenzene sulfonic acids and alcohols of from 3 to 6 carbon atoms is recommended as an emulsifier mixture for various carriers such as benzoates and p-chlorophenyl glycol ether. It has been found that these alcohols have no leveling effect. In said reference, they are used merely as agents for stabilizing emulsions of typical carriers based on aromatics.

It is an object of the present invention to provide an economical process for the level dyeing of polyester fibers whilst avoiding the above drawbacks of the prior art leveling agents.

In accordance with the invention, this object is achieved by a process of a kind defined above in which the dyeing assistant used is an aliphatic ester, nitrile or ketone each of from 7 to 16 carbon atoms.

The most suitable dyeing assistants are those compounds having a straight or only slightly branched carbon chain. Of those compounds showing a slightly branched carbon chain, the most suitable are those in which the branching consists of not more than one methyl or ethyl group. Suitable compounds of this kind are, for example, esters of carboxylic acids derived from aliphatic alcohols of from 1 to 12 carbon atoms, the methyl, n-propyl, isopropyl, n-butyl and isobutyl esters of enanthic acid, caprylic acid, pelargonic acid, capric acid, undecanoic acid and lauric acid, and esters of acetic acid, propionic acid, butyric acid and valeric acid in which the carbon number is from 7 to 16. I prefer to use the methyl and ethyl esters of caprylic acid, pelargonic acid and capric acid.

Also suitable are esters of dicarboxylic acids such as succinic, glutaric and adipic acids, particularly mixtures thereof. These dicarboxylic acids are produced, for example, as byproducts in the oxidation of cylcohexane to cyclohexanol and cyclohexanone. Those dicarboxylic esters which have carbon numbers between 10 and 16, particularly the propyl and butyl esters, are most effective, examples being dibutyl succinate, di-n-butyl glutarate, di-n-propyl glutarate, di-n-butyl adipate, di-isobutyl adipate, di-n-propyl adipate and dimethyldodecane dicarboxylate.

Suitable nitriles are, for example, the nitriles of enanthic, capric, caprylic, pelargonic, lauric and myristic acids. Also suitable are dinitriles having from 10 to 16 carbon atoms such as $\alpha,\omega$-dodedanonitrile.

Examples of ketones which may be used in the present invention are ethylheptyl ketone, methyloctyl ketone, ethylnonyl ketone, hexylmethyl ketone, lauric methyl ketone, myristic methyl ketone and myristic ethyl ketone. I prefer to use straight-chain aliphatic ketones in which one of the alkyl radicals is derived from a methyl or ethyl group.

1000 parts by weight of the aqueous liquor contain from 0.3 to 3 preferably from 0.5 to 2 parts by weight of the compounds recommended by the present invention. The dyeing assistants used in the invention preferably contain from 8 to 14 carbon atoms.

The aliphatic esters, nitriles or ketones containing from 7 to 16 carbon atoms are preferably used in the process of the invention in emulsified form.

The most suitable emulsifiers have been found to be mixtures of anionic and non-ionic surface-active agents. Particularly effective anionic components are alkali metal salts, for example sodium or potassium salts, or ammonium salts of sulfuric acid half esters of di- to tetra-ethoxylated fatty alcohols of from 9 to 18 carbon atoms or the corresponding salts of sulfuric acid half esters of di- to tetra-ethoxylated alkyl phenols of from 6 to 12 carbon atoms in the alkyl side chain or of alkylbenzene-sulfonic acids of from 6 to 12 carbon atoms in the alkyl side chain. These anionic surface-active agents are used in amounts of from 2.5 to 30 preferably from 5 to 20%, based on the weight of the above aliphatic esters, nitriles or ketones of from 7 to 6 carbon atoms.

Particularly advantageous anionic surface-active agents for dicarboxylic esters and dinitriles are alkali metal or amine salts of sulfonic acids of straight-chain paraffins of from 15 to 30 carbon atoms which have been obtained by saponification of sparingly sulfochlorinated products (containing from about 1 to 1.5 moles of sulfochloride per mole of paraffin). These compounds may contain from about 0.5 to 3 moles of organically combined chlorine which has been introduced into the carbon chain by side reactions. Also suitable as anionic components are alkali metal salts and amine salts of monophosphates and diphosphates of adducts of from 2 to 20 moles of propylene oxide or ethylene oxide with dicarboxylates or mixtures of said monophosphates and diphosphates.

Particularly suitable non-ionic surface-active agents are ethoxylated fatty acids containing from 5 to 15 moles of ethylene oxide or ethoxylated castor oil which has been reacted with 30 to 50 moles of ethylene oxide. The non-ionic surface-active agents are used in amounts of from 5 to 40% and preferably from 10 to 30%, by weight of the dyeing assistants to be used in the present invention.

The leveling effect of a leveling agent can be tested by treating dyed polyester material with undyed material at given temperatures for a given period in a liquor containing the products to be tested. The dyes migrate from the dyed material to the undyed material to a greater or lesser extent depending on the efficiency of the leveling agent. This test demonstrates the ability of a leveling agent to level out an uneven coloration or to prevent uneveness from the outset.

The emulsions of compounds to be used in the present invention show a leveling effect which is superior to that of the prior art leveling agents. Furthermore, they show none of the drawbacks associated with the prior art leveling agents, i.e., they show scarcely any retarding action and have virtually no effect on the lightfastness of the colorations or the tensile strength of the fibers. I have also found that the temperatures range within which dyes with different molecular sizes are taken up by the polyester fibers is reduced as a result of the addition of emulsions of the above liquor adjuvants according to the invention so that improved levelness is obtained. This is very important in producing level dyeings; in addition, the subsequent boiling treatment can be shortened if level take-up of the dyes has been achieved a priori.

Texturized polyester fibers often show varying affinities for, in particular, disperse dyes giving colorations which are highly resistant to sublimation, as a result of which dyeing from aqueous liquor produces streaky or uneven colorations. However, texturized polyester fibers may be dyed level shades with said dyes from an aqueous liquor at temperatures of from about 120° to 135°0 C if the additives of the invention are present. It will be appreciated that dyeing must be carried out at elevated pressure in order to achieve temperatures above 100° C. To this end, use is made of conventional high-temperature dyeing equipment.

By polyesters I mean high molecular weight polymeric esters of aliphatic or, preferably, aromatic dicarboxylic acids, for example terephthalic acid, and aliphatic diols, for example ethylene glycol. If desired, the polyesters may be modified, for example with sulfoisophthalic acid.

By ammonium salts I mean salts of ammonium or primary, secondary or tertiary amines in which the sum of the ligands per nitrogen atom contains a total of not more than 18, preferably not more than 9 carbon atoms.

In the following Examples, the leveling effect of the emulsified aliphatic esters, nitriles and ketones containing from 7 to 16 carbon atoms is demonstrated by the aforementioned leveling tests. These tests involve the use of a control liquor containing at least one of the emulsified additions of the invention or a mixture thereof or the prior art leveling agent used for comparison. Samples of dyed and undyed knitted fabrics of texturized polyester fibers are treated in said liquor for 1 hour at a temperature of 125° C. The effect obtained with the product tested compared with that of the prior art products may be best determined by comparing the depth of shade of the originally undyed material with the result obtained in the comparative example.

COMPARATIVE EXAMPLE ACCORDING TO GERMAN PUBLISHED APPLICATION NO. 1,184,730

10 parts by weight of fabric consisting of knitted texturized polyester fibers, dyed with 0.1 part by weight of monobrominated 1,5-dihydroxy-4,8-diaminoanthraquinone, are treated together with 10 parts by weight of undyed knitted fabric of the same material for 1 hour at 125° C, treatment being carried out with 400 parts by volume of an aqueous liquor containing 0.2 part by weight of 60% acetic acid and 1.2 parts by weight of 1,4-butanediol pentaglycol ether stearate.

The dyed material is lightened, whilst the undyed material is stained only slightly.

COMPARATIVE EXAMPLE 2 ACCORDING TO GERMAN PUBLISHED APPLICATION NO. 1,280,805

10 parts by weight of fabric consisting of knitted texturized polyester fibers, dyed with 0.2 part by weight of dispersed 1-amino-2-(4'-chlorophenoxy)-4-hydroxyanthraquinone are treated for 1 hour at 125° C together with 10 parts by weight of undyed knitted fabric of the same material with 500 parts by volume of an aqueous liquor containing 0.2 part by weight of an adduct of 2 moles of ethylene oxide and 1 mole of coconut fatty acid, 0.1 part by weight of polypropylene oxide having a molecular weight of 600, 0.1 part by weight of an adduct of 10 moles of ethylene oxide and 1 mole of nonyl phenol and 0.1 part by weight of an adduct of 30 moles of ethylene oxide and 1 mole of nonyl phenol.

The color of the dyed material is lightened slightly, whilst the undyed material is only slightly stained.

COMPARATIVE EXAMPLE 3 ACCORDING TO EXAMPLE 2 OF GERMAN PUBLISHED APPLICATION NO. 1,296,499

10 parts by weight of a knitted fabric of texturized polyester fibers, dyed with 0.3 part by weight of 4-(p-toluidino)-1-hydroxyanthraquinone, and 10 parts by weight of undyed knitted fabric of the same material are treated for 1 hour at 125° C with 500 parts by volume of a liquor containing 0.16 part by weight of an adduct of 10 moles of ethylene oxide and 1 mole of nonylphenol and 0.09 part by weight of hexaglycol oleate.

The color of the dyed material is lightened slightly, whilst the undyed material is only slightly stained.

COMPARATIVE EXAMPLE 4 ACCORDING TO GERMAN PUBLISHED APPLICATION NO. 1,619,489

10 parts by weight of a knitted fabric of texturized polyester fibers, dyed with 0.2 part by weight of the dye of the formula

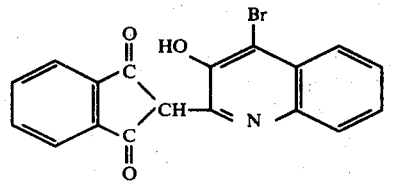

are treated together with 10 parts by weight of undyed knitted fabric of the same material for 1 hour at 125° C with 500 parts by volume of an aqueous liquor containing 0.7 part of n-hexanol, 0.15 part of an adduct of 6 moles of ethylene oxide and 1 mole of oleic acid and 0.15 part of the diethanolamine salt of the sulfuric acid half ester of an adduct of 3 moles of ethylene oxide and 1 mole of n-dodecyl alcohol.

The color of the dyed material is lightened only slightly, whilst the undyed material shows a relatively pale color.

The following Examples illustrate the process of the invention.

EXAMPLE 1

10 parts by weight of a knitted fabric of texturized polyester fibers, dyed with 0.3 part by weight of monobrominated 1,5-dihydroxy-4,8-diaminoanthraquinone, are treated for 1 hour at 125° C together with 10 parts by weight of undyed knitted fabric of the same material, the treatment being carried out in 500 parts by volume of a liquor containing 0.8 part by weight of methyl caprylate, 0.2 part by weight of an adduct of 40 moles of ethylene oxide and 1 mole of castor oil, 0.15 part by weight of the sodium salt of the sulfuric acid half ester of an adduct of 2 moles of ethylene oxide and 1 mole of n-decyl alcohol and 0.1 part by weight of glacial acetic acid.

The originally dyed material became distinctly paler in color and the originally undyed material was dyed a distinctly deeper shade than in Comparative Example 1.

Example 1 is repeated a number of times using in place of the monobrominated 1,5-dihydroxy-4,8-diamino-anthraquinone the dyes stated in Comparative Examples 2 to 4. In each case, the originally undyed material is dyed a much deeper shade than is the case in the Comparative Examples.

EXAMPLE 2

10 parts by weight of woven material of polyester fibers, dyed with 0.3 part by weight of monobrominated 1,5-dihydroxy-4,8-diamino-anthraquinone, are treated together with 10 parts by weight of woven fabric of the same material for 1 hour at 125° C in 500 parts by volume of an aqueous solution containing 0.7 part by weight of caprylonitrile, 0.15 part by weight of an adduct of 7 moles of ethylene oxide and 1 mole of oleic acid and 0.1 part by weight of the sodium salt of the sulfuric acid half ester of an adduct of 4 moles of ethylene oxide and 1 mole of octylphenol and, finally, 0.1 part by weight of glacial acetic acid. The originally dyed material becomes distinctly paler in color and the originally undyed material is dyed a much deeper shade than the material described in Comparative Example 1.

When the dyed materials described in Comparative Examples 2 to 4 are boiled with undyed material at a temperature of 125° C in the presence of the dye auxiliaries described in Example 2, the effects achieved are much better than in the said Comparative Examples.

EXAMPLES 3 TO 6

Example 1 is repeated except that the methyl caprylate used therein is replaced by ethyl caprate
ethyl enanthate
methyl enanthate and
methal caprate respectively to give, in all cases, a very good leveling effect which is much better than that obtained in the Comparative Examples.

EXAMPLE 7

10 parts by weight of a woven fabric of texturized polyester fibers, dyed with 0.3 part by weight of monobrominated 1,5-dihydroxy-4,8-diamino-anthraquinone, are treated together with 10 parts by weight of undyed woven fabric for 1 hour at 125° C with 500 parts by volume of a liquor containing 1 part by weight of di-n-butyl adipate, 0.15 part by weight of an adduct of 40 moles of ethylene oxide and 1 mole of castor oil, 0.1 part by weight of an adduct of 10 moles of ethylene oxide and 1 mole of tallow fatty acid and 0.15 part by weight of the sodium salt of a monosulfonic acid derived from a $C_{19-30}$ paraffin mixture and containing 5% by weight of organic chlorine and, finally, 0.1 part by weight of glacial acetic acid.

The originally undyed material is stained a distinctly deeper shade than in the corresponding Comparative Example 1.

EXAMPLE 8

10 parts by weight of knitted texturized polyester fibers, dyed with 0.3 part by weight of an azo dye consisting of diazotized 1-amino-2,4-dinitro-6-bromobenzene coupled to 2-methoxy-5-acetamino-N-β-propionitrile-β-hydroxyethyl aniline, are treated together with 10 parts by weight of undyed material for 1 hour at 130° C in 500 parts by volume of a liquor containing 1 part by weight of the di-n-butyl ester of a dicarboxylic acid mixture consisting of 20% succinic acid, 50% of glutaric acid and 30% of adipic acid, 0.1 part by weight of an adduct of 40 moles of ethylene oxide and 1 mole of castor oil, 0.1 part by weight of an adduct of 5 moles of ethylene oxide and 1 mole of oleic acid, 0.1 part by weight of the sodium salt of a monosulfonic acid derived from a $C_{19-30}$-n-paraffin mixture and containing 10% by weight of organically combined chlorine, 0.1 part by weight of the sodium salt of the monophosphate of an adduct of 5 moles of ethylene oxide and 10 moles of propylene oxide and 1 mole of coconut fatty alcohol and 0.05 part by weight of glacial acetic acid.

The originally undyed material is stained a distinctly deeper shade than is the case when this Example is repeated using the agents stated in Comparative Examples 1 to 4.

Similar results are obtained when use is made of the diisobutyl ester and the di-n-propyl ester and also of mixed esters of 1 mole of n-propanol and 1 mole of n-butanol of the dicarboxylic acid mixture stated in Example 8.

The following products were also tested for suitability as leveling agents:

butyl butyrate
isobutyl butyrate
2-ethylhexyl acetate
hexyl acetate
n-cetyl acetate
n-nonyl acetate
2-ethylhexyl propionate
n-hexyl propionate
n-heptyl propionate
n-nonyl propionate
n-octyl propionate
n-decyl propionate
2-methyloctyl propionate
n-propyl caprate
butyl caprate
n-propyl caprylate
isopropyl caprylate
ethyl caproate
methyl caproate
methyl laurate
methyl undecanoate
enanthonitrile
caprinonitrile
undecanonitrile
lauroyl nitrile
dibutyl ketone
dipentyl ketone
hexylpentyl ketone
heptylmethyl ketone
hexylmethyl ketone
octylmethyl ketone
nonylmethyl ketone
2-methylheptanone-6
ethylheptyl ketone.

All of the above compounds were used in Example 1 in place of methyl caprylate. The process was carried out as described in Example 1 and the leveling effect obtained with said compounds was somewhat weaker than when using the additives of the invention as described in Examples 1 to 6 but was much better than that obtained in the Comparative Examples.

I claim:

1. In a process for dyeing polyester fibers with a disperse dye under pressure and at a temperature above 100° C. in an aqueous liquor containing anionic and nonionic surface active agents as an emulsifier, the improvement which comprises carrying out the dyeing such that 1000 parts by weight of said aqueous liquor contain as the leveling agent from 0.3 to 3 parts by weight of an aliphatic compound selected from the group consisting of esters, nitriles and ketones having from 7 to 16 carbon atoms.

2. A process as claimed in claim 1, wherein said aliphatic compound has a straight carbon chain or a chain with not more than one methyl or ethyl branching.

3. A process as claimed in claim 1, wherein said surface active agent comprises a mixture of non-ionic and anionic compounds as emulsifiers.

4. A process as claimed in claim 3, wherein the non-ionic surface-active agents used are unsaturated fatty acids which have been ethoxylated with from 5 to 15 moles of ethylene oxide or similarly ethoxylated mixtures of saturated and unsaturated fatty acids and/or adducts of from 30 to 50 moles of ethylene oxide and 1 mole of castor oil.

5. A process as claimed in claim 3, wherein the anionic surface-active agents used are sodium salts, potassium salts or organic amine salts of sulfuric acid half esters of from di- to tetra-ethoxylated fatty alcohols containing from 9 to 18 carbon atoms, the corresponding salts of sulfuric acid half esters of di- to tetra-ethoxylated alkyl phenols containing from 6 to 12 carbon atoms in the alkyl side chain or of alkylbenzenesulfonic acids containing from 6 to 12 carbon atoms in the alkyl side chain.

6. A process as claimed in claim 1 wherein the dyeing is carried out at a temperature of about 120° to 135° C.

7. A process as claimed in claim 1 wherein said leveling agent is an ester selected from the group consisting of the methyl and ethyl esters of caprylic acid, pelargonic acid and capric acid.

8. A process as claimed in claim 1 wherein said leveling agent is a dicarboxylic acid dialkyl ester of between 10 and 16 carbon atoms.

9. A process as claimed in claim 1 wherein said leveling agent is a mono- or dinitrile of 7 to 16 carbon atoms.

10. A process as claimed in claim 1 wherein said leveling agent is a straight-chain aliphatic ketone in which one of the radicals attached to the ketone group is methyl or ethyl.

* * * * *